United States Patent [19]

Phillips

[11] 3,960,288

[45] June 1, 1976

[54] BOTTLE CAP WITH MEANS TO EFFECT SEAL WITH IRREGULAR BOTTLE ENDS

[76] Inventor: Edwin D. Phillips, 170 Albert St., North Plainfield, N.J. 07060

[22] Filed: Mar. 5, 1975

[21] Appl. No.: 555,533

[52] U.S. Cl. ..... 215/329; 215/31; 215/342; 215/347

[51] Int. Cl.[2] ..... B65D 41/04

[58] Field of Search ..... 215/276, 329, 330, 341, 215/347, 342

[56] References Cited

UNITED STATES PATENTS

| | | | |
|---|---|---|---|
| 860,338 | 7/1907 | Shearman | 215/341 |
| 3,272,369 | 9/1966 | Grimsley | 215/341 X |
| 3,326,401 | 6/1967 | DeLong | 215/329 |
| 3,421,648 | 1/1969 | Giessler | 215/276 |
| 3,565,274 | 2/1971 | Davidson | 215/329 |

*Primary Examiner*—Donald F. Norton
*Attorney, Agent, or Firm*—Shoemaker and Mattare, Ltd.

[57] ABSTRACT

A bottle cap made of Teflon and the like has a relatively thin end closure portion for engagement with a bottle end and an annular back-up flange is spaced axially of a peripheral marginal portion of the closure portion, and a resilient insert is disposed back-up the backflange and the marginal portion of the closure portion, whereby the closure portion is resiliently yieldable to effect a tight seal even with irregularly shaped bottle ends.

10 Claims, 3 Drawing Figures

BOTTLE CAP WITH MEANS TO EFFECT SEAL WITH IRREGULAR BOTTLE ENDS

BACKGROUND OF THE INVENTION

There are many different type of bottle closures or bottle end caps known in the prior art for closing and sealing the open ends of bottles and the like. Moreover, many such prior art bottle caps include resilient seals or gaskets for insuring a leak-tight seal with the bottle. However, bottles frequently have irregularly shaped end surfaces, and prior art bottle caps are not always effective to achieve a secure, leak-tight seal with such irregularly shaped bottle end surfaces. This is particularly true when relatively hard materials are used for the bottle end cap, such as Teflon and the like. There has been a recent increase in demand for bottle end caps made of Teflon because of the inherent properties of Teflon, and accordingly, some means is necessary in order to insure that Teflon bottle caps will achieve a leak-tight seal with irregularly shaped bottle end surfaces.

In accordance with the present invention, a resilient insert is provided between a relatively thin, yieldable end closure of the cap, and a relatively thick back-up flange is spaced from the end closure, with the insert provided between the flange and end closure, such that when the bottle cap is tightened on the end of a bottle and the like, the end closure and resilient insert are resiliently yieldable to enable the bottle cap to effect a secure and leak-tight seal with the bottle end surface.

OBJECT OF THE INVENTION

It is an object of this invention to provide an economical bottle cap having means therein for effecting a secure and leak-tight seal with bottle end surfaces, even if the bottle end surface has irregularities therein.

BRIEF DESCRIPTION OF THE DRAWINGS

FIG. 3 is a fragmentary, vertical, sectional view of the bottle cap according to the invention shown in sealing position on an end of a bottle and the like.

DETAILED DESCRIPTION OF THE INVENTION

Figure 1:
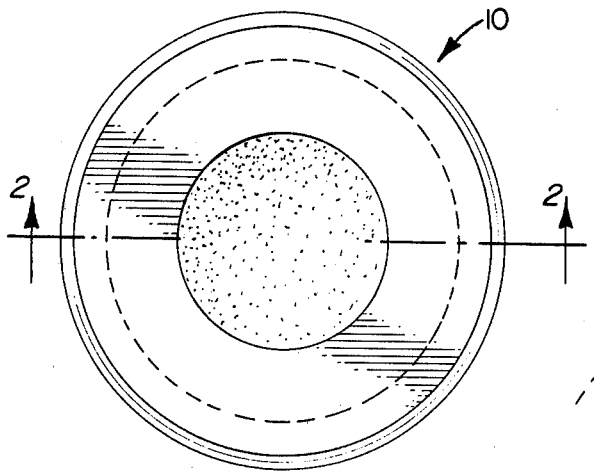
FIG. 1 is a top plan view of a bottle cap in accordance with the invention.
Figure 2:
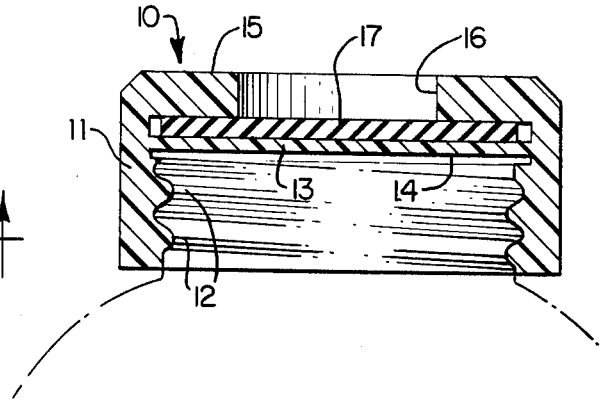
FIG. 2 is a vertical section view taken along line 2—2 of FIG. 1.

The bottle cap 10 according to the invention comprises a depending annular skirt 11 having internal fastening means therein, such as threads or the like 12, for mating association with complemental fastening means, such as threads or the like T, on a neck of a bottle or the like B. A relatively thin end closure portion 13 is integrally formed with the skirt 11 and spans the width of the bottle cap and has a marginal peripheral portion 14 for sealing engagement with an end surface S of the bottle B. An annular, radially inwardly extending back-up flange 15 is also integrally formed with the skirt 11 and extends radially inwardly over the marginal peripheral portion 14 of the end closure portion 13 in axially spaced relationship thereto and defines an annular space with the end closure portion 13. The annular back-up flange 15 terminates in a circular inner surface 16, defining an opening through the outer end of the bottle cap.

Figure 3:
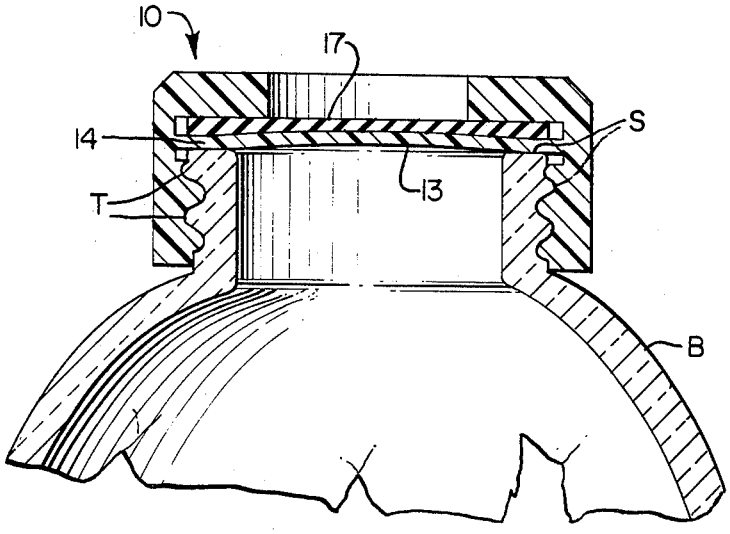

A disc-shaped resilient insert 17, of substantially the same diametral extent as the end closure portion 13, is disposed in the space between the back-up flange 15 and the end closure portion 13 and provides resilient support for the end closure portion 13, such that when the bottle cap is tightened on the neck of a bottle, as indicated in FIG. 3, the yieldable end closure portion 13 is flexed slightly, compressing the insert 17, and thus enabling the bottle cap to effect a secure and leak-tight seal with the end surface S of the bottle, even though there may be irregularities in the end surface S. The resilient insert 17 insures that the yieldable closure portion 13 returns to its original position for subsequent reuse of the bottle cap.

The bottle cap 10 is preferably made of a synthetic plastic material, such as Teflon and the like, and the insert 17 is preferably made of a rubber material, such as neoprene or natural rubber or Buna-N rubber. Moreover, the insert 17 preferably has an uncompressed thickness of approximately 3/32 of an inch and the end closure portion 13 preferably has a thickness of approximately 25/1000 of an inch. The back-up flange 15 is substantially thicker than the insert, and in a preferred embodiment, is approximately three times as thick as the insert 17. The cap, including skirt 11, closure portion 13 and flange 15, is preferably integrally molded, and the rubber insert 17 may be placed in operative position in any suitable manner, such as, for example, by inserting it through the opening defined by circular inner wall 16 of the flange 15.

Also, the surface S and threaded portion T of the bottle top are sandblasted or otherwise suitably treated to create a roughened surface on those portions of the bottle top which engage the cap, to thus effect a more secure fastening of the cap on the bottle and prevent the cap from inadvertently unscrewing from the bottle.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A bottle cap, comprising a synthetic plastic body having a depending annular skirt with fastening means therein for cooperable association with complemental fastening means on a bottle neck and the like; said cap including a relatively thin, yieldable end closure portion integral therewith, said closure portion having a lower surface contacting an end surface of the bottle for sealing engagement with said bottle end surface, and an upper surface presented oppositely of said lower surface; an annular back-up flange on the cap spaced axially from a peripheral, marginal portion of the closure portion; and a resilient disc-shaped insert located between the closure portion and the back-up flange and having a lower surface thereon which is in overlying relation with said closure portion upper surface to contact same over substantially the entire surface area thereof to provide resilient support for said closure portion over substantially the entire area thereof, whereby when the cap is tightened on a bottle the end closure portion is supported and resiliently and yieldably engages an end surface of the bottle to effect a tight seal therewith even if the end surface has irregularities therein.

2. A bottle cap as in claim 1, wherein the cap is made of Teflon, and the skirt, end closure portion and back-up flange are all integrally formed.

3. A bottle cap as in claim 2, wherein the insert is made of a rubber material.

4. A bottle cap made of Teflon having a depending annular skirt with fastening means therein for cooperable association with complemental fastening means on a bottle neck and the like; said cap including a relatively thin, yieldable end closure portion for sealing engagement with an end surface of a bottle; an annular back-up flange on the cap spaced axially from a peripheral, marginal portion of the closure portion; and a resilient disc-shaped insert between the marginal portion of the closure portion and the back-up flange, said insert located to span the width of the end closure portion in overlying relation thereto, whereby when the cap is tightened on a bottle the end closure portion resiliently and yieldably engages an end surface of the bottle to effect a tight seal therewith even if the end surface has irregularities therein, said skirt, end closure portion and back-up flange all being integrally formed.

5. A bottle cap as in claim 4, wherein the width of the back-up flange is greater than the width of the bottle end surface against which the end closure engages.

6. A bottle cap as in claim 5, wherein the back-up flange has a thickness more than three times as great as the thickness of the end closure portion.

7. A bottle cap as in claim 6, wherein the insert has a thickness greater than the thickness of the end closure portion.

8. A bottle cap as in claim 7, wherein the insert comprises natural rubber.

9. A bottle cap as in claim 7, wherein the insert comprises neoprene.

10. In combination, a bottle having an externally threaded, open ended top portion presenting an annular, axially facing end surface; and a synthetic plastic bottle cap threadably engaged on the threaded top of the bottle, said cap comprising a body having a depending annular skirt with internal threads therein cooperably engaged with the threads on the bottle top; said cap including a relatively thin, yieldable end closure portion sealingly engaged with the end surface of the bottle; an annular back-up flange on the cap spaced axially from a peripheral, marginal portion of the closure portion; and a resilient insert between the marginal portion of the closure portion and the back-up flange; and the externally threaded portion and annular end surface of the bottle top being roughened to effect a secure, non-slip threaded engagement with the cap, and whereby when the cap is tightened on the bottle the end closure portion resiliently and yieldably engages the end surface of the bottle to effect a tight seal therewith even if the end surface has irregularities therein.

* * * * *